US008986054B2

(12) United States Patent
Stadler et al.

(10) Patent No.: US 8,986,054 B2
(45) Date of Patent: Mar. 24, 2015

(54) CLAMP BODY FOR TERMINAL

(71) Applicants: Hermann Stadler, Donaueschingen (DE); Daniel Krause, Hüfingen (DE)

(72) Inventors: Hermann Stadler, Donaueschingen (DE); Daniel Krause, Hüfingen (DE)

(73) Assignee: MCQ Tech GmbH, Blumberg (DE)

( * ) Notice: Subject to any disclaimer, the term of this patent is extended or adjusted under 35 U.S.C. 154(b) by 190 days.

(21) Appl. No.: 13/742,947

(22) Filed: Jan. 16, 2013

(65) Prior Publication Data

US 2013/0210293 A1 Aug. 15, 2013

(30) Foreign Application Priority Data

Feb. 14, 2012 (DE) ..... 10 2012 202 240

(51) Int. Cl.

| | |
|---|---|
| ***H01R 4/38*** | (2006.01) |
| ***H01R 4/48*** | (2006.01) |
| ***H01R 4/34*** | (2006.01) |
| *H01R 4/30* | (2006.01) |

(52) U.S. Cl.

CPC ..... *H01R 4/489* (2013.01); *H01R 4/302* (2013.01); *H01R 4/34* (2013.01)

USPC ..... 439/801

(58) Field of Classification Search

CPC .. H01R 4/4845; H01R 4/4818; H01R 4/4827; H01R 13/11; H01R 13/111; H01R 4/34; H01R 4/64; H01R 11/12; H01R 11/26; H01R 4/30

USPC ..... 439/834, 801, 813

See application file for complete search history.

(56) References Cited

U.S. PATENT DOCUMENTS

| | | | | |
|---|---|---|---|---|
| 1,969,991 | A * | 8/1934 | Robinson | 439/742 |
| 3,340,497 | A * | 9/1967 | Balint | 439/872 |
| 3,421,135 | A * | 1/1969 | Soltysik et al. | 439/746 |
| 3,486,158 | A * | 12/1969 | Soltysik et al. | 439/92 |
| 3,609,654 | A | 9/1971 | Wallo | |
| 4,136,924 | A * | 1/1979 | Dobrosielski et al. | 439/801 |
| 4,900,259 | A * | 2/1990 | Ludwig et al. | 439/107 |
| 4,944,700 | A * | 7/1990 | Simon | 439/801 |
| 6,206,737 | B1 * | 3/2001 | Bonilla et al. | 439/801 |
| 6,743,029 | B1 * | 6/2004 | Greene et al. | 439/107 |
| 6,861,189 | B1 * | 3/2005 | Greene et al. | 439/107 |
| 7,264,518 | B2 * | 9/2007 | Ellis | 439/852 |
| 7,559,810 | B1 * | 7/2009 | Wu | 439/801 |
| 7,722,382 | B2 * | 5/2010 | Landis et al. | 439/393 |
| 7,731,544 | B2 * | 6/2010 | Ma et al. | 439/698 |
| 7,972,186 | B2 * | 7/2011 | Tsao | 439/876 |
| 8,083,532 | B1 * | 12/2011 | Nicholson et al. | 439/180 |
| 8,105,118 | B2 * | 1/2012 | Claprood, Jr. | 439/709 |

FOREIGN PATENT DOCUMENTS

| | | |
|---|---|---|
| DE | 36 43 593 A1 | 12/1986 |
| DE | 38 08 197 A1 | 3/1988 |
| GB | 2 396 752 A | 12/2002 |

* cited by examiner

*Primary Examiner* — Abdullah Riyami
*Assistant Examiner* — Vladimir Imas
(74) *Attorney, Agent, or Firm* — Todd L. Juneau

(57) ABSTRACT

This invention relates to a clamping body for a terminal, which is formed as a stamped and pressed part, wherein the stamped and pressed part has a base and two lateral surfaces positioned on the base, wherein an opening is positioned on the base, in which a screw with a screw head is positioned in such a way that the screw head is positioned on the side of the base facing away from the lateral surfaces, and wherein the screw engages with a threaded hole of a retaining plate positioned between the lateral surfaces non-rotatably around the longitudinal axis of the threaded hole, characterized in that the clamping body has devices for positioning the retaining plate at a distance from the base.

12 Claims, 5 Drawing Sheets

CLAMP BODY FOR TERMINAL

CROSS REFERENCE TO RELATED APPLICATIONS

This patent application claims priority to German Patent Application 10 2012 202 240.6, filed on Feb. 14, 2012.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

1. Field of the Invention

The invention relates to a clamping body for a terminal.

Clamping bodies for a terminal are known, which are formed as a stamped and pressed part, wherein the stamped and pressed part has a base and two lateral surfaces, particularly at a right angle, positioned on the base, wherein an opening is positioned on the base, in which a screw with a screw head is positioned in such a way that the screw head is positioned on the side of the base facing away from the lateral surfaces, and wherein one of the ends of the screws facing away from the screw head engages with a threaded hole of a retaining plate positioned between the lateral surfaces non-rotatably around the longitudinal axis of the threaded hole. In such clamping bodies for connecting an electrical conductor to a connecting contact, a circuit board or another electrical conductor, the electrical conductor is clamped through the retaining plate provided with the threaded hole being drawn against the base of the clamping body by means of the screw, and thereby clamping the electrical conductor between the retaining plate and the clamping body.

One problem with these types of terminals is that the retaining plate with the screwed in screw, in an open state, can move freely in the longitudinal direction of the screw. Therefore, a frequent occurrence is that the retaining plate, caused by the installation position or vibrations, for example, rests on the base of the clamping body and thus no space remains to insert the electrical conductor. In order to connect the electrical conductor, force must first be applied to push the retaining plate away from the base of the clamping body, which makes it much more difficult to connect.

2. Background of the Invention

The current state of knowledge is as follows.

The object of the invention is therefore to improve a clamping body for a terminal and particularly to develop it to be user-friendly.

In particular, the invention provides a terminal clamping body that prevents the retaining plate from resting on the base of the clamping body. This allows for greater ease in connecting with a conductor as it does not require the user to apply force to push the retaining plate away from the base of the clamping body during connection.

BRIEF SUMMARY OF THE INVENTION

In a preferred embodiment, a clamping body for a terminal, which is formed as a stamped and pressed part, wherein the stamped and pressed part has a base and two lateral surfaces, particularly at a right angle, positioned on the base, wherein an opening is positioned on the base, in which a screw with a screw head is positioned in such a way that the screw is positioned on the side of the base facing away from the lateral surfaces, and wherein one of the ends of the screws facing away from the screw head engages with a threaded hole of a retaining plate positioned between the lateral surfaces non-rotatably around the longitudinal axis of the threaded hole, characterized by the fact that the clamping body features devices to position the plate at a distance from the base. Through these devices, the plate is held securely in an open position in the clamping body, as long as the screw is not actuated. It is thus ensured that the clamping body, independent of the mounting position, is ready to receive an electrical conductor without requiring additional handling by the user. The devices are configured in such a way that upon actuation of the screw, the devices can be overcome, and in particular, the plate can be moved to a smaller distance from the base, in order to securely clamp the inserted electrical conductor. The distance in which the retaining plate is positioned to the base is preferably greater than the diameter of the electrical conductor to be connected, so that the electrical conductor can be inserted without obstructions.

In another preferred embodiment, the devices are formed as at least one resilient element, which is positioned on one of the lateral surfaces. A resilient element can secure the retaining plate in the desired position and be formed in such a way that upon actuation of the screw, the spring action of the resilient element is overcome and the retaining plate can be moved in the direction of the base, wherein one or more of the resilient elements give way.

Particularly preferable is a resilient element positioned at each of the lateral surfaces in order to prevent the retaining plate tilting in the clamping body, and in particular to allow the positioning of the retaining plate essentially in parallel at a distance from the base.

In another preferred embodiment, the resilient element in the lateral surface is formed as a pressed element or as a stamped and pressed element, which allows particularly simple and economical manufacturing, because no additional elements need to be positioned in or on the clamping body.

In another preferred embodiment, the devices are formed as a protrusion positioned on one of the lateral surfaces. This essentially causes the retaining plate to be initially positioned and held on one side behind the protrusion, and when exercising force on the retaining plate by actuating the screw, the lateral surfaces springily give way, allowing the retaining plate to be pulled past the protrusion and towards the base of the clamping body.

In another preferred embodiment, a soldering pin is integrated with the clamping body or otherwise positioned in order to easily establish contact between the clamping body and a circuit board.

In another preferred embodiment, the disclosed clamping body further comprises a contact spring, integrated with the clamping body or otherwise positioned in order to easily establish contact between the clamping body and another electrical conductor or a plug contact.

In another preferred embodiment, the clamping body is connected or integrated with a second clamping body according to the invention in order to easily allow multiple electrical conductors to be connected or interconnected.

Preferably, the clamping body according to the invention is used in a terminal. In another preferred embodiment, a terminal is provided comprising the disclosed clamping body. In a more preferred example, the terminal also comprises an insulating housing to accommodate the clamping body and to protect the user.

DETAILED DESCRIPTION OF THE INVENTION

Definitions

Detailed Description of the Figures

Figure 1:
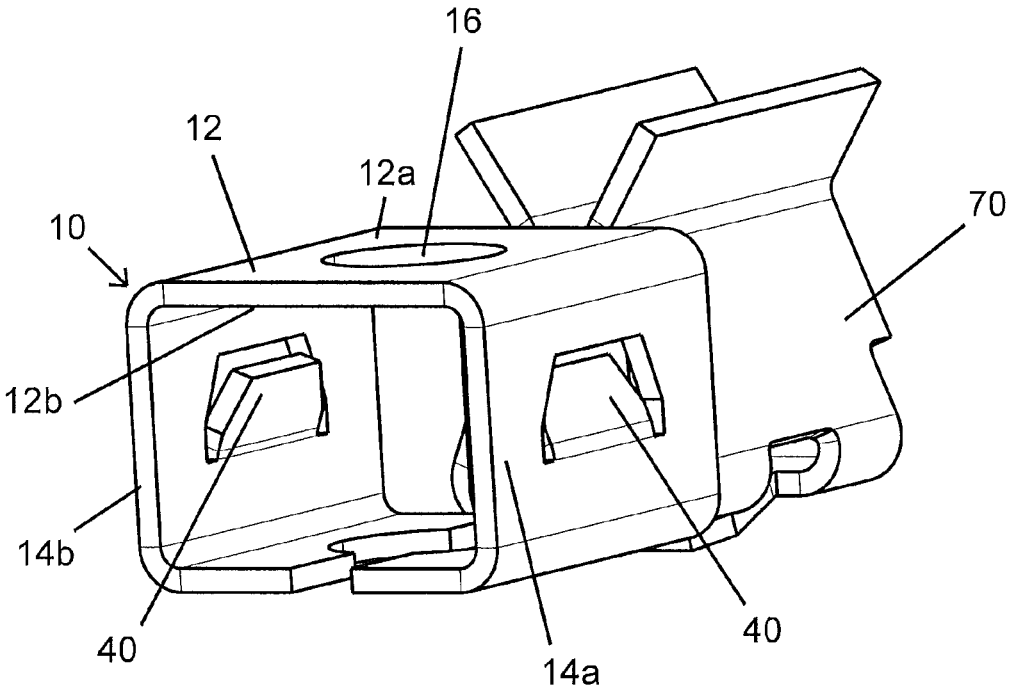
FIG. 1 shows a perspective view of a first design example of a clamping body according to the invention.
Figure 2:
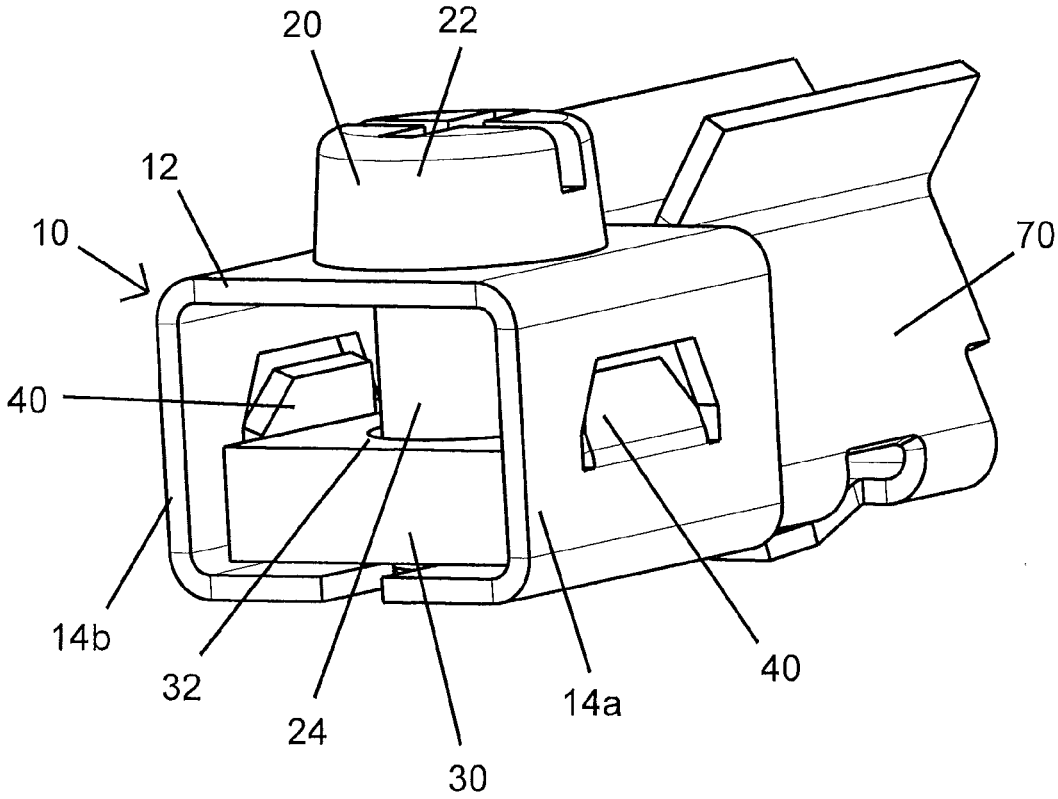
FIG. 2 shows the clamping body according to FIG. 1 with screw and retaining plate in an open position.
Figure 3:
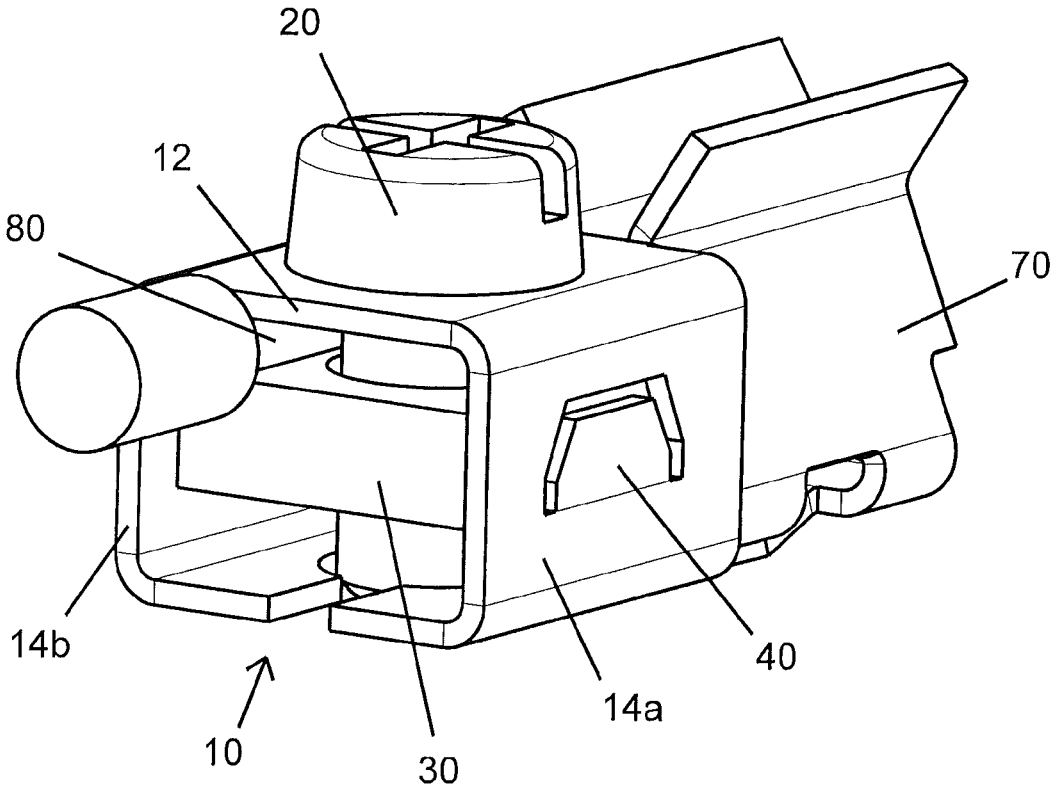
FIG. 3 shows the clamping body according to FIG. 2 with an electrical conductor inserted and the retaining plate in a clamping position.

FIGS. 1 to 3 show a clamping body 10 with a base 12 with a side 12*a*, which is hereinafter also referred to as the outer side, and a side 12*b*, which is hereinafter also referred to as the inner side. Two lateral surfaces 14*a*, 14*b* are positioned on the base essentially parallel to each other, which are particularly essentially positioned vertically on the base 12 and particularly on the inner side 12*b* of the base 12. This results in an approximately U-shaped element. The free ends of the lateral surfaces 14*a*, 14*b* can be formed in an alternative style like in FIGS. 1 to 3, in such a way that they are angled towards each other and preferably positioned essentially parallel to the base 12, so that it results in a frame-like element.

An opening 16 is positioned in the base 12, in which, as shown particularly in FIG. 2, a screw 20 can be inserted. The screw 20 is positioned in the opening 16 in such a way that a screw head 22 of the screw 20 rests on the side 12*a* opposite the lateral surfaces 14*a* in the base 12, while a shaft 24 of the screw 20 protrudes through the opening 16 in the clamping body 10.

Between the two lateral surfaces 14*a*, 14*b*, a retaining plate 30 is positioned, which is approximately rectangularly formed, for example, and is positioned with two opposing lateral edges running parallel to the lateral surfaces 14*a*, 14*b*. The retaining plate 30 has a threaded hole 32 into which the shaft 24 of the screw 20 can be screwed. If the screw 20 is screwed into the threaded hole 32, the retaining plate 30 is held between the two lateral surfaces 14*a*, 14*b* non-rotatably around the longitudinal axis of the threaded hole 32, so that it is pulled towards the base 12 of the clamping body 10 when the screw 20 is screwed into the threaded hole 32. An electrical conductor 80, as shown in FIG. 3, can be clamped between the inner side 12*b* of the base 12 and the retaining plate 30.

The clamping body 10 is formed as a stamped and pressed part in order to allow for simple and economical manufacturing.

As shown in FIG. 1, a resilient element 40 is positioned in each of the lateral surfaces 14*a*, 14*b*. This is preferably stamped out of the lateral surfaces 14*a*, 14*b* and bent into the space clamped open by the lateral surfaces 14*a*, 14*b* and the base 12. The resilient elements 40 are particularly formed in the manner of a flat spring. The resilient elements 40 particularly with their free end point towards the base 12.

The resilient elements 40 prevent the retaining plate 30, through vibration or the installation position for example, from approaching the base 12. The resilient elements 40 are positioned on the lateral surfaces 14*a*, 14*b* in such a way that a gap remains between the retaining plate 30 and the base 12, which in particular is larger than the diameter of the electrical conductor 80, in particular to allow insertion of the electrical conductor 80 into the clamping body 10 in any installation position of the clamping body 10 without additional handling. The resilient elements 40 are sized in such a way that upon rotation of the screw 20, which pulls the retaining plate 30 towards the base 12, the force of the resilient elements 40 is overcome and it is possible to pull the retaining plate 30 in the direction of the base 12, and thereby clamp the electrical conductor 80 between the retaining plate 30 and the base 12 (see FIG. 3). The resilient elements 40 are thereby particularly driven back into the lateral surfaces 14*a*, 14*b*.

In an alternative design, protrusions can be positioned on the lateral surfaces 14*a*, 14*b*, which position the retaining plate 30 at a distance from the base 12. Through the fact that the lateral surfaces 14*a*, 14*b* can be fitted with a resilient feature as opposed to the base 12, it is still possible to pull the retaining plate 30 against the base 12 over the protrusions by tightening the screw 20, wherein the lateral surfaces 14*a*, 14*b* outwardly give way.

Figure 4:
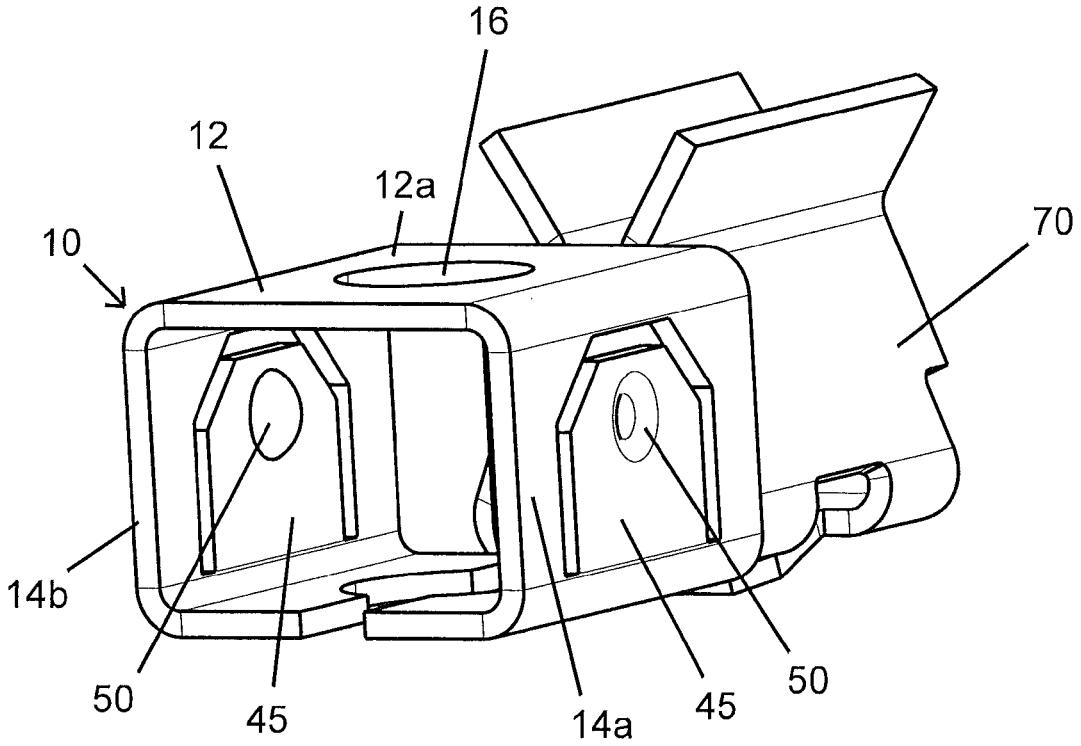
FIG. 4 shows a perspective view of a second design example of a clamping body and FIG. 5 shows a perspective view of a third design example of a clamping body.

As shown in the design example according to FIG. 4, such protrusions 50 can be positioned particularly on the resilient elements positioned in the lateral surfaces 14*a*, 14*b*. The protrusions 50 are formed in a dome shape, for example. The resilient elements 45 are preferably stamped out of the lateral surfaces 14*a*, 14*b*, but do not necessarily have to be bent out of the lateral surfaces 14*a*, 14*b*, because the protrusions 50 take over the positioning of the retaining plate 30. The protrusions 50 can in particular be placed in the lateral surfaces 14*a*, 14*b* in an embossing process.

The design example according to FIGS. 1 to 3 and the design example according to FIG. 4 have a contact spring 70, which is particularly integrally positioned on the clamping body 10, and through which the electrically conductive contact can be produced between the electrical conductor 80 clamped by the devices of the retaining plate 30 and a plug contact, a circuit board or another electrical conductor.

Figure 5:
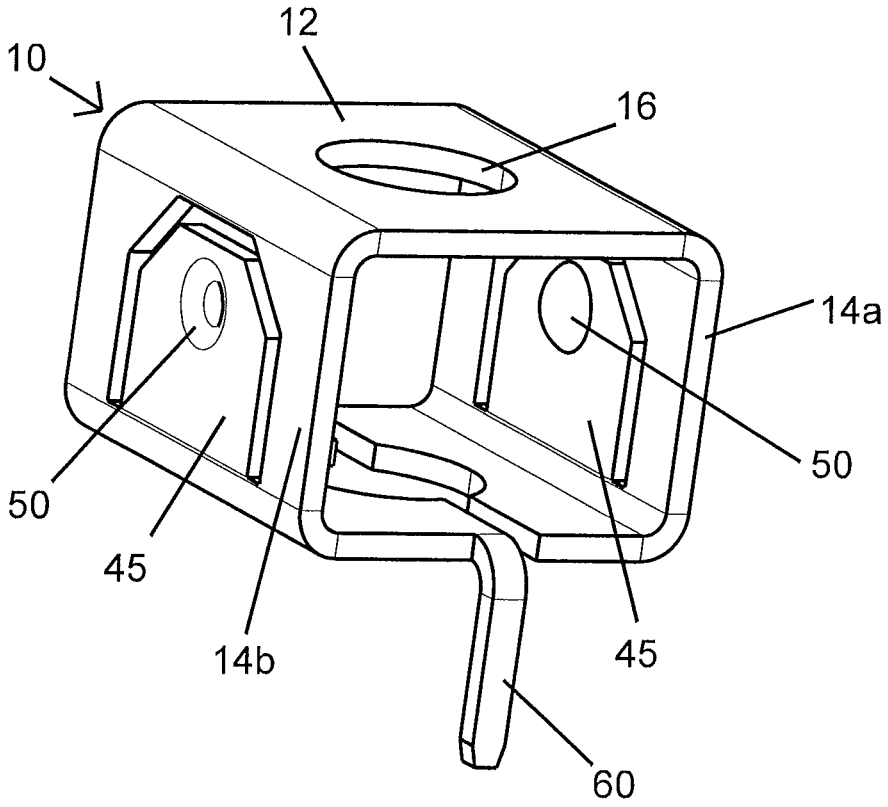

Instead of—or, where appropriate, in addition to—the contact spring 70, a soldering pin 60, as shown in the design example according to FIG. 5, can be positioned on the clamping body 10, preferably integrally.

In a further alternative design which is not shown in the figures, several clamping bodies can be connected to each other, particularly integrally, according to the previously described design examples, in order to connect two or more wires with each other.

LIST OF REFERENCE NUMBERS

10 Clamping body
12 Base
14*a* Lateral surface
14*b* Lateral surface
16 Opening
20 Screw

22 Screw shaft
24 Shaft
30 Retaining plate
32 Threaded hole
40 Resilient element
45 Resilient element
50 Protrusion
60 Soldering pin
70 Contact spring
80 Electrical conductor The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable Equivalents.

We claim:

1. A clamping body for a terminal, comprising a stamped and pressed part, wherein the stamped and pressed part has a base and two lateral surfaces positioned on the base, wherein an opening is positioned on the base, in which a screw with a screw head is positioned in such a way that the screw head is positioned on the side of the base facing away from the lateral surfaces, wherein the screw engages with a threaded hole of a retaining plate positioned between the lateral surfaces non-rotatably around the longitudinal axis of the threaded hole, and further comprising one or more resilient elements stamped and pressed from the lateral surfaces to form a protrusion(s) towards the center of the clamping body, thereby positioning the retaining plate at a distance from the base.

2. The clamping body of claim 1, further comprising wherein the devices are formed as at least one resilient element, which is positioned on one of the lateral surfaces.

3. The clamping body of claim 2, further comprising wherein a resilient element is positioned on each of the lateral surfaces.

4. The clamping body of claim 2, wherein the resilient element is formed as a stamped element of a stamped and pressed element.

5. The clamping body of claim 3, wherein the resilient element is formed as a stamped element of a stamped and pressed element.

6. The clamping body of claim 1, wherein the devices are formed as a protrusion on one of the lateral surfaces.

7. The clamping body of claim 1, further comprising wherein a soldering pin is positioned, particularly integrally, on the clamping body.

8. The clamping body of claim 1, further comprising wherein a contact spring is positioned on the clamping body.

9. The clamping body of claim 1, further comprising wherein a contact spring is integrated onto the clamping body.

10. The clamping body of claim 1, further comprising wherein the clamping body is connected to a second clamping body of claim 1.

11. The clamping body of claim 1, further comprising wherein the clamping body is integrated with a second clamping body of claim 1.

12. A terminal comprising the clamping body of claim 1.

* * * * *